United States Patent [19]

King et al.

[11] 3,969,135

[45] July 13, 1976

[54] LOW TEMPERATURE ALUMINUM CLEANING COMPOSITION AND PROCESS

[75] Inventors: Peter F. King, Farmington Hills; Douglas D. Fekete, Warren, both of Mich.

[73] Assignee: Oxy Metal Industries Corporation, Warren, Mich.

[22] Filed: Feb. 13, 1975

[21] Appl. No.: 549,644

[52] U.S. Cl. ..... 134/41; 134/3; 134/40; 252/142

[51] Int. Cl.[2] ..... C11D 1/72; C11D 7/08

[58] Field of Search ..... 252/142, 146, 79.3, 252/79.4; 134/3, 41, 40

[56] References Cited

UNITED STATES PATENTS

| | | | |
|---|---|---|---|
| 2,719,781 | 10/1955 | Hesch | 252/142 X |
| 2,746,849 | 5/1956 | Helling et al. | 252/142 X |
| 3,162,547 | 12/1964 | Kendall | 252/142 X |
| 3,634,262 | 1/1972 | Grunwald et al. | 134/3 X |
| 3,692,583 | 9/1972 | Mucenieks et al. | 134/3 |
| R27,662 | 6/1973 | Hamilton | 252/79.4 |

*Primary Examiner*—Harris A. Pitlick
*Attorney, Agent, or Firm*—Arthur E. Kluegel; Richard P. Mueller; Bertram F. Claeboe

[57] ABSTRACT

Aluminum surfaces are cleaned at low temperature by the addition of a polyalkylene glycol-abietic acid surfactant and a polyalkylene glycol-hydrocarbon surfactant to an aqueous acidic solution. Preferably, the solution contains fluoride as an accelerator.

8 Claims, No Drawings

LOW TEMPERATURE ALUMINUM CLEANING COMPOSITION AND PROCESS

BACKGROUND OF THE INVENTION

This invention relates to the art of cleaning aluminum surfaces. More particularly, it relates to the art of cleaning aluminum surfaces which have been previously subjected to cold forming operations during which organic lubricants are applied to the aluminum surface, a residue of which remains on the surface after forming is completed.

Metal surface cleaning is essential to the efficacy of many metal finishing operations. Thoroughly cleaned surfaces are much more receptive to subsequent corrosion preventive treatments and the application of organic finishes. Cleaning is especially important in the case of aluminum surfaces which have been cold formed such as drawn and ironed aluminum cans.

In accordance with current procedures for manufacturing aluminum cans, circular blanks are stamped from aluminum sheet. The blanks are then formed into cups with a suitable die or cupping press and the thus-formed cups are then drawn or ironed in one or more stages to form the cup into a can of the desired dimensions. Normally these forming operations are assisted and the dies and metallic surface protected by the application of lubricants to the surface prior to or during the forming operations. As a result of this manufacturing process, the fully-formed can contains residual quantities of the organic lubricant on the surface and in addition contains metallic particles called smut which are formed on the can surface as a result of the drawing operation. It is essential that the residual lubricant and smut be removed from the surface prior to further treatment.

Conventional techniques for cleaning such aluminum surfaces employ both alkaline and acidic aqueous solutions. Such solutions are typically operated at a temperature of from 180° to 210°F in order to obtain adequate cleaning within a reasonable period of time. The conventional acidic solutions may contain, in addition to an acidic component, a hexavalent chromium compound, a fluoride accelerating compound, and a surfactant. To date, however, it has not been found possible to clean such surfaces through the use of an energy-saving low-temperature solution.

SUMMARY OF THE INVENTION

It has now been discovered that an aluminum surface may be cleaned in a reasonable period of time with aqueous solutions maintained at a temperature not in excess of 130°F. In accordance with the present invention, the cleaning composition is an aqueous, acidic solution containing a hydrocarbon derivative surfactant and an abietic acid-derivative surfactant. The hydrocarbon-derivative surfactant may be represented by the general formula $R(OR')_nOH$ and the abietic acid derivative surfactant may be represented by the general formula $A(R'O)_nH$ wherein R is an alkyl or alkylaryl group of 8–22 carbon atoms; R′ is a divalent radical selected from ethylene, propylene and combinations thereof; each n is an integer from 7 to 22; and A is the abietic acid radical. Preferably the solution contains fluoride as an accelerator.

The present invention also includes a process for cleaning an aluminum surface employing the foregoing aqueous solution wherein the surface is contacted with the cleaning solution for a period from ten seconds to five minutes.

DETAILED DESCRIPTION OF THE INVENTION

The concentration of the components in the solution and operating parameters of the present invention are dependent to some extent upon the condition of the surface to be cleaned and the contemplated post-treatments. The particular type and quantities of organic lubricants employed during the drawing operation, the severity of the drawing, and the condition of the dies among other variables will determine the strength of the solution required to attain a surface sufficiently free of contaminants for desired subsequent treating operations.

The hydrocarbon-derivative surfactant employed in the present cleaner may be represented by the following general formula $R(OR')_nOH$ wherein R is an alkyl or alkylaryl group of 8-22 carbon atoms; R′ is a divalent radical selected from ethyl, propyl and combinations thereof and n is an integer from 7 to 22. The desired concentration of this surfactant is bounded at the lower end by the extent of cleaning required and at the upper end by the stability of the surfactant in the aqueous acidic cleaner. The range of 0.01 to 5 weight percent or higher has been found suitable with a range of 0.05 to 0.21 weight percent being preferred and concentration of about 0.08 wt.% being most preferred. Commercially available surfactants believed to fall within the above general formula are described in the examples which follow. These surfactants contain both alkyl and alkylaryl R groups, ethoxy and propoxy R′ groups with n values ranging from 8 to 16.

The abietic acid-derivative surfactant may be represented by the general formula $A(R'O)_nH$ wherein R′ and *n* are as defined above and A is the abietic acid radical. As demonstrated by the following examples, the abietic acid-derivative surfactant functions conjointly with the hydrocarbon-derivative surfactant to remove all of the types of organic contaminants which may remain on the surface subsequent to ordinary cold forming operations. The desired concentration ranges are the same as those for the hydrocarbon-derivative surfactants. Commercially available surfactants are Surfactant AR 150 supplied by Hercules, Inc. and Pegosperse 700-TO supplied by Glyco Chemicals, Inc. Both of these commercially available surfactants serve as source of an abietic acid ester containing approximately 14 to 16 moles of ethoxylation.

It has been found that variations in the alkylene oxide ends groups of either of the above surfactants does not adversely affect their efficacy. The final hydroxy group may be replaced, for example, by a chloride substituent. Alkyl or aryl substitutions may also be made.

The pH value of the cleaning solution should be maintained at a value not in excess of 2, preferably in the range of 0.8 to 1.5, most preferably about 1.2. The pH values below the desired range tend to increase pickling of the surface to an undesired extent whereas more alkaline pH values increase the time for accomplishing the desired cleaning. Acidity may be supplied by any suitable inorganic or organic acid. Sulfuric acid is preferred.

The preferred fluoride component of the cleaner accelerates the attack upon the metal surface and the removal of the smut or metallic particles which result from the cold forming operation. It is believed that the surfactants function to remove the lubricant residues thereby rendering the surface more readily accessible to attack by the acid components of the solution with fluoride accelerating the rate of attack. Apparently, the abietic acid derivative surfactant functions primarily to remove typical medium-duty water emulsified lubricating oils from the surface whereas the hydrocarbon derivative surfactant functions to remove the more difficult to emulsify oils which come in contact with the metallic surface either through design design or through unavoidable leakage of hydraulic oils employed in the cold forming press in the surface lubricating system. Regardless of the specific manner in which the solution functions, the cleaner of the present invention will clean aluminum surfaces at much lower temperatures than heretofore attainable. Corresponding savings in energy may be realized.

The effective fluoride concentration in the cleaner should normally be maintained at a value not in excess of 0.4 wt. % and preferably in the range of from .001 to .01 wt. %. It has been found that as aluminum surfaces are continuously cleaned in a fluoride containing solution, a build-up of aluminum fluoride complexes may occur. The fluoride present in the aluminum complex does not play an active part in the attack on the metallic surface required for proper cleaning. Likewise, fluoride present as other stable complexes such as fluoborate or silicofluoride does not attach the surface. Consequently, the term effective fluoride concentration refers to that fluoride present in the solution which is not complexed in the above manner. It has been found that a fluoride concentration of about 0.003 wt. % is normally sufficient to effect acceptable cleaning in a one minute spray cleaning application. Excessive fluoride levels tend to result in etching of the metallic surface to an undesirable extent.

While any source of fluoride sufficient to provide the desired effective fluoride concentration is suitable, the preferred source of fluoride is hydrofluoric acid and other sources of simple fluoride such as the alkali metal or ammonium fluoride salts.

Any conventional technique may be employed as a means of contacting the cleaner with the metallic surface. In the case of aluminum cans, spray application is preferred. Best results are obtained if the cleaner is maintained above the cloud point of the solution. Depending upon the specific surfactants employed, temperatures of about 100° F or higher are normally satisfactory. The temperature of the cleaner will typically be maintained between 110° and 130° F and preferably about 120°F. Contact times depend upon the condition of the surface to be cleaned but will usually vary from ten seconds to five minutes with times of less than two minutes normally being sufficient.

As a further advantage, especially important in the case of spray cleaning, the cleaner of the invention exhibits anti-foaming characteristics so that in many instances a commercial defoamer is unnecessary.

The utility and preferred mode of practicing the present invention are illustrated by the following examples.

EXAMPLE I

An aqueous cleaning solution was prepared to contain the following:

| COMPONENT | Wt. % |
|---|---|
| Hydrocarbon-derivative surfactant[1] | .08 |
| Abietic acid-derivative surfactant[2] | .08 |
| Fluoride (added as HF) | .004 |
| $H_2SO_4$ | to pH about 1.2 |

[1]Triton CF-10 supplied by Rohm & Haas Co. and believed to contain a hydrocarbon chain of about 14 carbon atoms and approximately 16 moles of ethoxylation.
[2]Surfactant AR 150 supplied by Hercules, Inc. and believed to be an ethoxylated abietic acid derivative with approximately 15 moles of ethoxylation.

An aluminum can which had been drawn with the aid of organic lubricants was then contacted with the solution by spray application for one minute at 120°F. The cleaned surface was observed, and it was noted that water wetting of the surface was uniform (no waterbreak) indicating efficient cleaning. It was further noted that when the surface of the can was wiped, only minor quantities of the smut particles formed during drawing remained on the surface. Similar results were obtained at surfactant concentrations of from 0.06 to 0.12% and pH values down to 0.8.

COMPARATIVE EXAMPLE IA

When the same tests were conducted without the surfactants, the cleaned can evidenced severe waterbreak and heavy smut (the wiping surface was almost black) indicating poor cleaning.

COMPARATIVE EXAMPLE IB

Pluronic L61 supplied by BASF Wyandotte, Inc., a condensate containing only ethylene oxide and propylene oxide chains was substituted for the hydrocarbon-derivative surfactant of Example I. Considerable waterbreak was observed on the can surface subsequent to cleaning.

EXAMPLE II

Example I was repeated employing other hydrocarbon-derivative surfactants falling within the general formula in place of the Triton CF-10 surfactant and similar cleaning results were obtained. The surfactants employed were:

| SURFACTANT | SUPPLIER |
|---|---|
| Antarox LF-330 | GAF Corporation |
| Antarox BL-330 | GAF Corporation |
| Igepal CA-630 | GAF Corporation |
| Trycol LF-1 | Emery Industries, Inc. |
| Plurafac D-25 | BASF Wyandotte Corp. |

EXAMPLE III

A solution was prepared as in Example I with Antarox LF330 substituted as the hydrocarbon-derivative surfactant. Aluminum can surfaces cleaned as in Example I were free of water breaks.

To simulate the contamination effects of a used cleaner solution, 100 ml of 10% solution of Texaco 591 drawing oil was added to 5 gallons of the cleaning solution. Aluminum can surfaces cleaned in the simulated cleaner still exhibited no waterbreak.

COMPARATIVE EXAMPLE IIIA

An aqueous cleaning solution was prepared as in Example III except that the solution contained 0.158% of the Antarox LF330 hydrocarbon-derivative surfactant and no abietic acid-derivative surfactant. When aluminum cans were cleaned as in Example I considerable waterbreak was observed indicating poor cleaning. Upon addition of 75 ml of the above drawing oil to 5 gallons of the cleaner, an even greater waterbreak was observed.

EXAMPLE IV

A solution was prepared as in Example 1 to contain 0.06 wt. % of each surfactant. In this case, HF was used as the sole source of acidity. At 0.011% $F^-$ (pH 2.6), the can surface was waterbreak-free with only slight smut and at 0.017%$F^-$ (pH 2.3) the surface was smut and waterbreak-free.

COMPARATIVE EXAMPLE IVA

When Example IV was repeated with no fluoride (pH 7.9) no cleaning effect was observed.

EXAMPLE V

In this example, the concentration of the surfactants and pH were varied. At about 0.004%$F^-$ the concentration of each surfactant was varied from 0.02 to 0.13 wt. % and the pH from 0.9 to 1.23. Can surfaces cleaned as in Example I were waterbreak-free.

EXAMPLE VI

In this example, fluoride was not added as an accelerator. The Antarox LF330 and Surfactant AR 150 were employed at equal concentrations of 0.38 wt. % and pH 1.2. Can surfaces which were immersed for a period of from 5–10 minutes at 120°F were smut and waterbreak-free.

What is claimed is:

1. An aqueous acidic composition suitable for the low temperature cleaning of aluminum surfaces comprising both a first hydrocarbon derivative surfactant having the general formula:

$R(OR')_nOH$ and a second abietic acid derivative surfactant having the general formula:

$A(R'O)_nH$ wherein R is an alkyl or alkylaryl group of 8–22 carbon atoms; R′ is a divalent radical selected from ethylene, propylene and combinations thereof; each n is an integer from 7 to 22; and A is the abietic acid radical; said surfactants being present in amounts sufficient to remove both readily emulsifiable and difficult-to-emulsify oils.

2. The composition of claim 1, wherein each surfactant is present in a concentration of at least 0.01 wt.%.

3. The composition of claim 1, wherein the pH of the solution is adjusted to a value not in excess of 2.0.

4. The composition of claim 2, wherein each surfactant is present in a concentration of at least 0.05 wt.%.

5. The composition of claim 1, containing fluoride in an effective concentration of from 0.001 to 0.4 wt. %.

6. A process for cleaning an aluminum surface comprising contacting the surface with the composition of claim 1.

7. The process of claim 6, wherein the composition is maintained at a temperature not in excess of about 130°F.

8. The process of claim 6, wherein the composition is sprayed on the surface for a period of 10 seconds to 5 minutes.

* * * * *